United States Patent [19]

Freedom

[11] 4,417,410

[45] Nov. 29, 1983

[54] INDICIA MEANS FOR KEYS

[76] Inventor: John Freedom, 17100 S. Harlem Ave., Tinley Park, Ill. 60477

[21] Appl. No.: 314,098

[22] Filed: Oct. 23, 1981

[51] Int. Cl.[3] ..... G09F 3/00

[52] U.S. Cl. ..... 40/330

[58] Field of Search ..... 40/2 A, 330, 21; 63/29

[56] References Cited

U.S. PATENT DOCUMENTS

| | | | |
|---|---|---|---|
| 1,619,582 | 3/1927 | Long | 40/2 A X |
| 1,796,751 | 3/1931 | Faircloth | 40/2 A |
| 2,533,006 | 12/1950 | Goldsmith | 40/330 |
| 3,204,360 | 9/1965 | Ehmcke | 40/330 |
| 3,263,444 | 8/1966 | Di Croce | 63/29 M X |
| 3,324,586 | 6/1967 | Mitchell | 40/330 |

*Primary Examiner*—Gene Mancene

*Assistant Examiner*—Wenceslao J. Contreras

*Attorney, Agent, or Firm*—Basil E. Demeur; Robert E. Knechtel; Alan B. Samlan

[57] ABSTRACT

An identifying tag affixed to a key wherein the identifying tag has a surface area which receives the identifying indicia. The identifying tag has opposite ends with locking or latching members so that the opposite ends can be fastened together. The identifying tag is dimensioned so that it can pass through at least two receiving holes in the key and then have the latching members engaged so that the identifying tag is securely retained to the key. The identifying tag is generally made from a flexible material so that the tag can be easily manipulated by the user to pass through the receiving holes and then latched.

17 Claims, 7 Drawing Figures

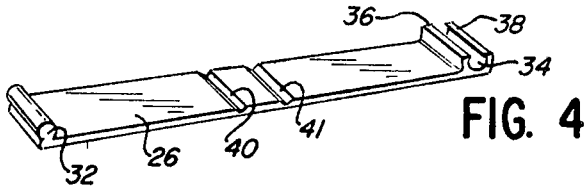
FIG. 4
FIG. 1
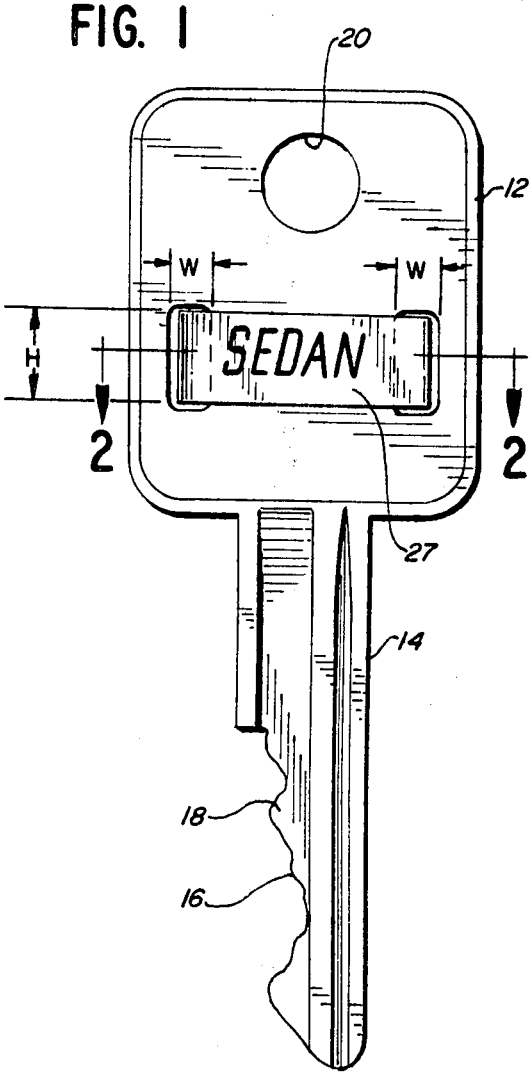
FIG. 3
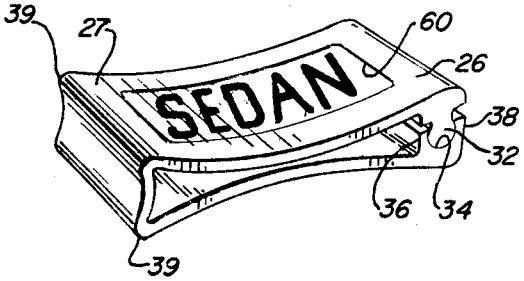
FIG. 5
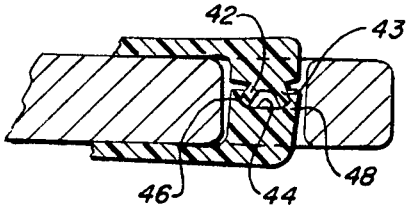
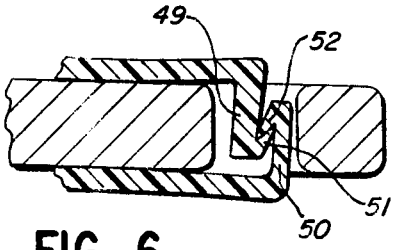
FIG. 6
FIG. 2
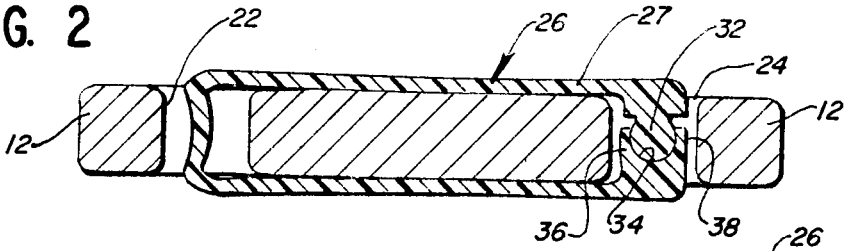
FIG. 7
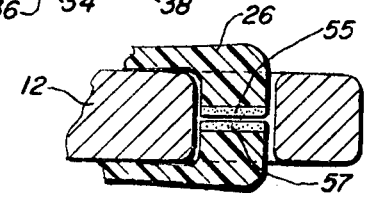

INDICIA MEANS FOR KEYS

BACKGROUND OF THE INVENTION

This invention relates to a means for identifying keys and more particularly, a unique identifying lock tag including a display surface for the identifying indicia, and means to lockingly engage the tag to a key.

It has become apparent in recent years that due to security problems involved in the safe storage of valuables, and security problems involved in the prevention of crime, that locks have been employed on an extremely wide assortment of devices including vehicles, doors, safes, drawers, and other similar such applications. Indeed, it has become quite common that the average person may the requirement to have access to as many as ten or more different lock devices in connection with their daily existence. For example, typically the average person will carry two distinct keys to an automobile, house keys which may include different locks for both front, rear and basement doors, keys for a locked garage, office keys, and one or more keys which gives the person access to locked devices within the home. It is also apparent that personnel involved in commercial operations have an even more pronounced problem since there are various situations where a single person will be responsible for access to an extremely great number of locks. For example, maintenance and security personnel generally carry key rings having an excess of fifty keys per ring. Building mainagement personnel, similarly, will have rings carrying often times a number of keys in excess of 100 keys for access to the different locks located within the building under their control and management.

The problem is further enhanced by reason of the fact that the numbers of manufacturers who manufacture and sell locking devices has, in the recent past, become less numerous, such that one will find a great number of locks manufactured and sold by the same manufacturer. Generally, locks manufactured and sold by the same manufacturer will have the keys having a similar appearance, and it is therefore not unlikely to find that one will be carrying a number of keys which appear to be similar in overall configuration, but which are keyed to fit distinct locks. Hence, the problem of key identification has become more difficult with time, and the problem is further enhanced where the personnel involved must be able to quickly identify and utilize a particular key especially in an emergency situation.

The typical solution to key identification has, in the past, been to apply a tag through the single key aperture which permits the user to inscribe some key identifying indicia onto the tag, the tag being retained to the key usually and typically by a wire or spring ring of some type inserted in the key aperture. Another method which has been employed for key identification is to apply an adhesive strip of tape of one form or another directly to the surface of the key head, the user then applying some type of identifying indicia directly onto the tape. Neither of the above solutions has been found to be particularly suitable for the reason that tags which are affixed to the key aperture by means of a wire or spring clip have the tendency to tear away and are also bulky when a great number of keys are applied on the same ring along with identifying tags. It has also been found that where tags are applied with a wire ring, and a number of keys are applied on the same ring, the wire rings often become entangled. Where an adhesive tape strip is applied to the surface of the key head, generally, the oils secreted by the fingers of a person will cause the ink or graphite which is usually employed as the writing identifying means on the adhesive tape to smear with the result that the writing contained thereon becomes illegible. In addition, it is usually noticeable that with time, the adhesive becomes less tacky, causing the adhesive strip to removes itself from the key. Once the identifying indicia has been removed from the key, it becomes extremely difficult for the user to have knowledge as to the particular lock which is intended to be operated by a particular key.

It will also be appreciated that in commercial applications, where employed persons are in charge of rings having numerous keys, in the event a key identifying tag or indicia is lost or removed from a key, the employed person having no prior experience or knowledge as to which key may operate a particular lock, it becomes virtually impossible for such a person to subsequently rediscover the proper key-lock combination. It has therefore been deemed desirable to develop an improved but yet simplified key identifying indicia means for use in connection with any key which will permit the user to clearly identify a key by means of a removable key identifying tag.

OBJECTS AND ADVANTAGES

The principal object of the present invention is to provide a simplified but efficient key identifying tag which may be easily marked with key identifying indicia and easily and simply applied to a key in a removably engageable fashion.

A further object of the present invention is to provide a key identifying tag which may be secured to the key head through appropriate apertures provided, and lockingly engaged thereon.

In conjunction with the foregoing object, it is yet a further object of the invention to provide an identifying tag for keys which is formed from an elongate strip of flexible material having opposed ends, each of the opposed ends including mating locking means, such that the opposed ends may be inserted through opposed apertures provided in the key head, and the matingly engaging latching means be interconnected to engage the identifying tag onto the surface of the key head.

Still in conjunction with the foregoing object, it is a further object of the present invention to provide an identifying tag for keys of the type described wherein the identifying tag includes a surface writing area compatible with receiving for display identifying indicia thereon.

Yet a further object of the present invention is to provide a key identifying tag of the type described wherein the elongate strip of flexible material assumes a flat contour configuration such that the identifying tag rests smoothly against the surface of the key head.

A further object of the present invention is to provide an identifying tag for use with keys wherein the key is provided with a pair of opposed apertures positioned through the key head, and the identifying tag is formed from a strip of flexible material being substantially rectangular in configuration, and having opposed ends, each of the opposed ends including matingly engaging latching means such that the strip of flexible material may be inserted through the first aperture and carried through the second aperture in the key head, and the opposed ends matingly engaged to latch the key identifying tag in position on the surface of the key head.

A further object of the present invention, in conjunction with the foregoing objects, and as an alternative embodiment, it is to provide a key which includes a pair of opposed apertures positioned through the key head and wherein the lateral space between the opposed apertures is indented a distance substantially equivalent to the thickness of the key identifying tag, such that when the key identifying tag is inserted through the opposed apertures and lockingly engaged in position, the major surface area of the key identifying tag will rest within the indented area formed in the surface of the key head to provide a smooth and nesting engagement of the key identifying tag relative to the surface of the key head.

Further features of the invention pertain to the particular arrangement of the elements and parts whereby the above outlined and additional operating features thereof are attained.

The invention both as to its organization and method of operation, together with further objects and advantages thereof will best be understood be reference to the following specification, taken in connection with the accompanying drawings.

BRIEF DESCRIPTION OF DRAWINGS

FIG. 1 is a front view of a key with the novel identifying means.

FIG. 2 is a cross section view taken along the lines 2—2 of FIG. 1.

FIG. 3 is a perspective view of the key identifying tag in its locked position.

FIG. 4 is a perspective view of an alternative key identifying tag in its opened position.

FIG. 5 and FIG. 6 are cross section view with portions removed of two alternative key identifying tags having different locking means.

FIG. 7 is a side elevation view in cross section showing still an alternative locking arrangement for locking the ends of the key identifying tag into position on the key head portion of a key.

SUMMARY OF THE INVENTION

In summary, the present invention provides a novel and simplified form of a key identifying tag formed by a strip of flexible material which is substantially rectangular in configuration having opposed ends and each of the opposed ends including matingly engaging latching means in order to lockingly engage the identifying tag in position on the key. The identifying tag is formed of a material suitable for accepting identifying indicia imprinted thereon.

DETAILED DESCRIPTION OF DRAWINGS

Reference is made to FIG. 1 which illustrates one embodiment of the invention of this application. A conventional key 10 has a head portion 12 and extending therefrom is a bit portion 14. The bit 14 generally has cuts 16 and projections 18 which cause pins in a tumbler-type lock to properly align thereby allowing the lock to be opened. The head portion 12 generally has a circular hole 20 punched in it towards one end of the head opposite the bit 14.

Between the hole 20 and the bit 14 are two rectangular holes 22 and 24 each having a width W and a height H. Generally, each rectangular hole is placed near the lateral sides of the head portion 1. An identifying tag 26 is placed through the rectangular holes 22,24 and latched or locked so that the identifying tag 26 is securely retained to the head 12. The identifying tag 26 preferably has a height and width when taken in cross section which is less than the height and width of the holes 22 and 24.

The two rectangular holes 22 and 24 may be cut into the head portion 12 of the key by an appropriate hole punch tool. It is contemplated that a portable version of a hole punch will be developed for consumer use which can be sold as a package with a packet of identifying key tags in accordance with the present invention.

The identifying tag 26 has at least one indicia receiving surface 27 whereby each identifying tag can carry its own identifying markings. The surface 27 is primarily dependent on the material from which the identifying tag 26 is manufactured, since the identifying tag can be manufactured from numerous materials. Preferably, plastics or rubber compounds would be used in that a flexible finished product is desirable. Furthermore, there materials are relatively inexpensive, easily formed, and can be manufactured with a surface adaptable to receive markings from pens, pencils, or other markers so that they are not easily rubbed off or removed. The receiving surface 27 could be formed in such a manner that it has a pebbled surface to receive markings as opposed to a smooth surface which would tend to allow the ink or markings to be rubbed off. Other manufacturing techniques would allow a plastic surface to carry a non-glare, roughened surface which again would be a satisfactory surface to receive markings which would not easily be removed.

The identifying tag 26 is locked after being passed through the holes 22 and 24. The latching or locking means can take any one of several forms. FIG. 2 illustrates the use of a cylindrical rod 32 which is at one end of the tag 26 and generally extends at a 90° angle relative to the surface 27. The cylindrical rod 32 is received by a socket 34 at the other end of the tag 26. The socket 34 is formed between side walls 36 and 38. The socket 34 and side walls, 36 and 38 also extend at substantially a 90° angle relative to the identifying tag 26. Thus, the rod 32 and socket 34 are in face to face confrontation and can easily be latched by exerting pressure on the opposite ends when the locking means face each other forcing the side walls 36 and 38 to spread apart allowing the rod 32 to be received by the socket 34. After the rod 32 is received by socket 34, the material of which the walls are formed causes the walls 36 and 38 to reclose around the rod 32 firmly retaining the rod 32 in a locking relationship. This locking means could be opened by introducing a screw driver or similar bladed device into the socket 34 and forcing the two ends of the tag apart. Thus, the socket 34 would have the rod 32 pulled from it allowing the tag to be removed.

FIG. 3 illustrates a tag 26 manufactured by a plastic extrusion process so that it has formed corners 39 separated a distance slightly greater than the thickness of the key. This allows the tag to maintain a close profile with the surface of the key head 12 by not having large radius bends at the corners which would cause the tag to protrude an undesirable distance from the surface. The extruded blank can be cut at desired intervals to provide the tag 26 with the overall desired height.

FIG. 4 illustrates an alternative identifying tag 26 which has folding grooves 40 and 41 to form the corners about which the tag can be bent as it is passed through the holes 22 and 24 so that the long surface of the tag 26 rests against the face of the key 10 for the same reasons as the tag of FIG. 3. The tag which is shown in FIG. 4 could also be manufactured by a plastic extrusion process then cut to the desired height for individual tags. The folding grooves 40 and 41 should also be positioned so that each long surface 45 and 47 of the tag 26 is substantially equal. Also, the length of each of the long surfaces 45 and 47 of the tag 26 should be substantially equal to the spacing between the rectangular holes 22 and 24.

FIG. 5 illustrates an alternative locking means. Again the latch and latch receiving means are formed at the ends of the tag 26 and extend substantially 90° angles relative to the surface of the tag 26. The locking means in FIG. 4 is formed by pins with tapered ends, 42 and 43 which are received by a receiving socket 44. The socket 44 has side walls 46 and 48 which expand outwardly to accept the pins 42 and 43. Just as the side walls 36 and 38 expand to receive the rod 32 and reclose around the rod, the side walls 46 and 48 expand and reclose around the pins 42 and 43 thereby retaining the pins in a locking relationship.

FIG. 6 illustrates anouther locking mechanism. There are perpendicular fingers 49 and 50 which extend substantially at 90° angles relative to the surface of the tag 26. Finger 49 has an upstanding barb 51 and finger 50 has a mating downturned barb 52. By pushing the two fingers towards each other, the barbs 51 and 52 pass over one another and then catch one another in latching relationship. By dimensioning the barbs 51 and 52, so that the barbs overlap a substantial amount, this type of locking mechanism cannot be easily oulled apart thereby destroying the tag 26.

As shown in FIG. 7, still another alternate form of lockingly engaging the tag 26 onto the key head 12 of a key is illustrated. It will be observed that the opposing ends of the tag 26 is each provided with a layer of cold adhesive 55 and 57 respectively such that when the ends of the tag 26 are pressed together, the cold adhesive strips 55 and 57 will come into contact, and secure the tag 26 into position. It will be appreciated that this embodiment contemplates that the tag 26 will be permanently affixed to the key head 12 such that should the user intend to change the identifying indicia contained on the tag 26, he would simply cut the tag 26 from the key head 12 and insert a new tag 26 having the proper written indicia inscribed thereon. It is contemplated that the adhesive which may be employed is of the type generally referred to as a cold adhesive, which is a type of adhesive which will only adhere to itself. These types of adhesives are known and commercially available, and are designed such that the adhesive will adhere to no other surface or material other than to itself. Hence, by applying a layer on the opposed ends of each of the two ends of the tag 26, and the protective fim removed, the adhesive layers may simply be pressed together which will cause a permanent seal. It will also be appreciated to remove the tag, once installed, it will be necessary to cut the tag, or otherwise to destroy the tag in order to remove the same.

It is further contemplated that the key could be manufactured at the source of manufacture by having the holes 22 and 24 punched into the head portion 12 by the manufacturer. In this eventuality, it is further contemplated that the center portion of the head portion 12 could be appropriately indented or grooved for a distance of approximately equal to the thickness of the identifying tag 26. This will permit the tag 26 to lay substantially flush with respect to the head portion 12 of the key to present a smooth and appealing head surface of the key to the user.

In a further alternative embodiment, and as depicted in FIG. 3 of the drawings, a portion of the top surface intended to carry the written indicia may be intended or grooved during the manufacturing process. In this embodiment, it is contemplated that the user may insert embossed or raised lettering or other indicia for the purpose of identifying the key to which the tag 26 is applied, such that the tag 26 may be useful to handicapped users, such as blind people. By forming an indentation 60 along the top surface thereof, a blind person may easily, be sense of feel, determine the portion of the tag 26 having the indicia contained therein, and then by sense of feel, determine the identification contained in the form of the indicia contained therein thereby identifying the proper lock and key combination.

It will be appreciated from the above description that pursuant to the present invention, there has been provided an identifying tag for use in connection with keys with keys which greatly improves upon the present identifying tag means presently available. The identifying tag of the present invention incorporates locking means associated therewith to lockingly engage the tag to the key and prevent removal therefrom without some degree of effort on the part of the user.

Other types of locking mechanisms could be designed by those skilled in the art. However, the preferred mechanisms would be at the ends of the tags and extend in the same direction at substantially 90° relative to the surface of the tag 26. They should latch within the thickness of the key and the latching should take place between the two surfaces of the key head. This keeps the tag 26 to a minimum thickness and also protects the latching mechanism inadvertently being released by coming in contact with other keys, or objects which tend to pry the latching mechanism open.

While there has been described what is at present considered to be the preferred embodiment of the invention, it will be understood that various modifications may be made therein and it is intended to cover in the appended claims all such modifications as found in the true spirit and scope of the invention.

I claim:

1. Key identifying means comprising an identifying tag having a surface area compatible with receiving for display identifying indicia, the identifying tag being substantially rectangular and having opposite ends with latching means on one of the ends, and latch receiving means on the other end thereof, the latching means being located adjacent one of the shortest sides of the tag and the latch receiving means being located adjacent the other shortest side of the tag, the latching means projecting at a substantially 90° angle relative to the surface area of the key, and being formed by a barbed member, the latch receiving means comprising a complementary barb retaining member, one of the opposite ends being dimensioned to be received by and passed through at least two receiving holes in a key, whereby when the latching means is engaged with the latch receiving means the identifying tag is securely retained to the key.

2. The key identifying means of claim 1, wherein the identifying tag is formed from flexible plastic material.

3. The key identifying means of claim 1 wherein the identifying tag is formed from flexible rubber material.

4. The key identifying means of claim 1 wherein the identifying tag comprises grooves parallel to the shortest sides to provide folding lines for the tag; whereby when the tag is latched at least one groove is positioned on each side of the key causing the tag to conform to the contour of the key.

5. A key identifying means therefor wherein the key has a head portion with at least two receiving holes, and the identifying means comprises:

an identifying tag having a surface area compatible with receiving for display identifying indicia, opposite ends on the identifying tag with locking means on each of the ends such that one end engages the other end in locking relationship, the locking means being formed by a barbed member on one of the ends and a complementary barb retaining member on the other end, the tag being dimensioned with at least one of the ends smaller than the receiving holes so that it can pass through the receiving holes and then engage in locking relationship with the other end whereby the identifying tag is retained by means of the receiving holes.

6. The key and identifying means therefor of claim 5 wherein the receiving holes are substantially rectangular having a height and a width, and the identifying tag is substantially rectangular in cross section having a tag height and tag width, the tag height being less than the height of the hole and the tag width being less than the width of the hole.

7. The key and identifying means therefor of claim 6 wherein the identifying tag is substantially rectangular and the latching means are located adjacent one of the shortest sides of the tag and the latch receiving means are located adjacent the other shortest side of the tag.

8. The key and identifying means therefor of claim 7 wherein the latching means project at substantially a 90° angle relative to the surface area.

9. The key and identifying means therefor of claim 5 wherein the identifying tag is formed from flexible plastic.

10. The key and identifying means therefor of claim 5 wherein the identifying tag is formed from flexible rubber.

11. A key identifying means therefor wherein the key has a head portion with at least two receiving holes, and the identifying means comprises:

an identifying tag having a surface area compatible with receiving for display identifying indicia, opposite ends on the identifying tag with locking means on each of the ends such that one end engages the other end in locking relationship, the tag being dimensioned with at least one of the ends smaller than the receiving holes so that it can pass through the receiving holes and then engage in locking relationship with the other end whereby the identifying tag is retained by means of the receiving holes and, grooves parallel to the shortest sides to provide folding lines for the tag, whereby when the tag is latched at least one groove is positioned on each side of the key causing the tag to conform to the contour of the key head.

12. Key identifying means comprising an identifying tag having a surface area compatible with receiving for display, identifying indicia, the identifying tag being substantially rectangular and having opposite ends with latching means on one of the ends, and latch receiving means on the other end thereof, the latching means being located adjacent one of the shortest sides of the tag and the latch receiving means being located adjacent the other shortest side of the tag, the latching means projecting at a substantially 90° angle relative to the surface area of the key, and being formed by a cylindrical member, the latch receiving means comprising a complementary cylindrical receiving socket to securely retain the cylindrical member, one of the opposite ends being dimensioned to be received by and passed through at least two receiving holes in a key, whereby when the latching means is engaged with the latch receiving means the identifying tag is securely retained to the key.

13. Key identifying means comprising an identifying tag having a surface area compatible with receiving for display, identifying indicia, the identifying tag being substantially rectangular and having opposite ends with latching means on one of the ends, and latch receiving means on the other end thereof, the latching means being located adjacent one of the shortest sides of the tag and the latch receiving means being located adjacent the other shortest side of the tag, the latching means projecting at a substantially 90° angle relative to the surface area of the key, and being formed by a flexible pin, the latch receiving means comprising a complementary pin receiving member having pin retaining walls, one of the opposite ends being dimensioned to be received by and passed through at least two receiving holes in a key, whereby when the latching means is engaged with the latch receiving means the identifying tag is securely retained to the key.

14. The key identifying means of claim 12 wherein the identifying tag is formed from flexible plastic material.

15. The key identifying means of claim 12 wherein the identifying tag comprises grooves parallel to the shortest sides to provide folding lines for the tag, whereby when the tag is latched at least one groove is positioned on each side of the key causing the tag to conform to the contour of the key.

16. The key identifying means of claim 13 wherein the identifying tag is formed from flexible plastic material.

17. The key identifying means of claim 13 wherein the identifying tag comprises grooves parallel to the shortest sides to provide folding lines for the tag, whereby when the tag is latched at least one groove is positioned on each side of the key causing the tag to conform to the contour of the key.

* * * * *